US011109680B1

(12) United States Patent
Liu

(10) Patent No.: US 11,109,680 B1
(45) Date of Patent: Sep. 7, 2021

(54) SHELVING DEVICE

(71) Applicant: Tsai Thing International Technology Ltd., Taichung (TW)

(72) Inventor: Chien-Pang Liu, Taichung (TW)

(73) Assignee: Tsai Thing International Technology Ltd., Taichung (TW)

( * ) Notice: Subject to any disclaimer, the term of this patent is extended or adjusted under 35 U.S.C. 154(b) by 0 days.

(21) Appl. No.: 16/868,289

(22) Filed: May 6, 2020

(51) Int. Cl.
*A47B 96/07* (2006.01)

(52) U.S. Cl.
CPC ..... *A47B 96/07* (2013.01)

(58) Field of Classification Search
CPC ..... A47B 96/07; A47B 96/005; A47H 27/00
USPC ..... 108/157.13, 157.15–158.11
See application file for complete search history.

(56) References Cited

U.S. PATENT DOCUMENTS 488,608 A * 12/1892 Hotchkiss ..... F21V 21/08 248/214
557,875 A * 4/1896 Pittet ..... E06B 7/28 248/236
1,224,127 A * 5/1917 Bartlett ..... A47B 96/07 248/208
1,627,241 A * 5/1927 Johnson ..... A47B 5/04 248/236
1,788,800 A * 1/1931 McGinley ..... A47B 31/06 220/482
2,246,432 A * 6/1941 Cohen ..... B60N 3/007 108/47
2,538,449 A * 1/1951 Freshwater ..... A47B 23/02 248/115
2,583,838 A * 1/1952 Hart ..... 108/27
3,125,040 A * 3/1964 Roberson ..... A47B 31/06 108/18
4,057,031 A * 11/1977 Williams ..... A01K 1/0353 119/28.5
4,897,958 A * 2/1990 Brydges ..... A47H 27/00 248/208
5,636,816 A * 6/1997 Burton ..... F24F 13/32 248/208
5,842,423 A * 12/1998 Stranford ..... A47B 21/0314 108/42
6,032,589 A * 3/2000 Wang ..... F16M 7/00 108/147.11
6,378,945 B1 * 4/2002 Krueger ..... A47C 9/00 108/158
9,420,887 B2 * 8/2016 Reviel ..... A47B 97/00
9,498,063 B2 * 11/2016 Borgen ..... A47B 96/027
9,814,305 B2 * 11/2017 Brus ..... A47B 5/02
10,842,262 B2 * 11/2020 Zimmerman ..... A47B 23/02
(Continued)

*Primary Examiner* — Daniel J Troy
*Assistant Examiner* — Timothy M Ayres
(74) *Attorney, Agent, or Firm* — Muncy, Geissler, Olds & Lowe, P.C.

(57) ABSTRACT

A shelving device is provided, including: a carrier, including two sides which are opposite to each other and two first assembling mechanisms disposed on the two sides; at least one support mechanism, each of the at least one support mechanism being detachably assembled with one of the two first assembling mechanisms, including a support leg extending laterally to a periphery of the carrier and being configured to be abutted on an installation environment; and a blocking member, adjustably disposed on at least one of the two sides, configured to be positionally abutted on the installation environment.

7 Claims, 10 Drawing Sheets

(56) References Cited

U.S. PATENT DOCUMENTS

| | | | | |
|---|---|---|---|---|
| 2005/0193625 | A1* | 9/2005 | Rosser | A47G 7/044<br>47/68 |
| 2009/0008349 | A1* | 1/2009 | Kim | F16M 13/02<br>211/150 |

* cited by examiner

SHELVING DEVICE

BACKGROUND OF THE INVENTION

Field of the Invention

The present invention relates to a shelving device.

Description of the Prior Art

In homes or offices, there is a need to store small items such as stationery books, accessories, daily necessities, bottles, cans or other objects. A large part of the space on the desk has been occupied after a display or monitor is placed on the desk or hung on a wall, which causes insufficient space for use.

Therefore, a small shelf or bookshelf is generally furnished to meet the needs of placing and storing objects. However, the conventional shelf or bookshelf will occupy a considerable amount of space, which will greatly reduce the space and results in inconvenient operation, etc. Moreover, the shelf or bookshelf are has a generally fixed configuration, so it cannot be adjusted according to the needs of different installation environments, the installation is more inconvenient, and its applicability is extremely limited.

The present invention is, therefore, arisen to obviate or at least mitigate the above-mentioned disadvantages.

SUMMARY OF THE INVENTION

The main object of the present invention is to provide a shelving device which can be optionally supported directly on one single article or supported between two articles.

To achieve the above and other objects, a shelving device is provided, including: a carrier, including two sides which are opposite to each other and two first assembling mechanisms disposed on the two sides; at least one support mechanism, each of the at least one support mechanism being detachably assembled with one of the two first assembling mechanisms, including a support leg extending laterally to a periphery of the carrier and being configured to be abutted on an installation environment; and a blocking member, adjustably disposed on at least one of the two sides, configured to be positionally abutted on the installation environment.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIGS. 1 to 5 for a preferable embodiment of the present invention. A shelving device 1 includes a carrier 10, at least one support mechanism 20 and a blocking member 30.

Figure 1:
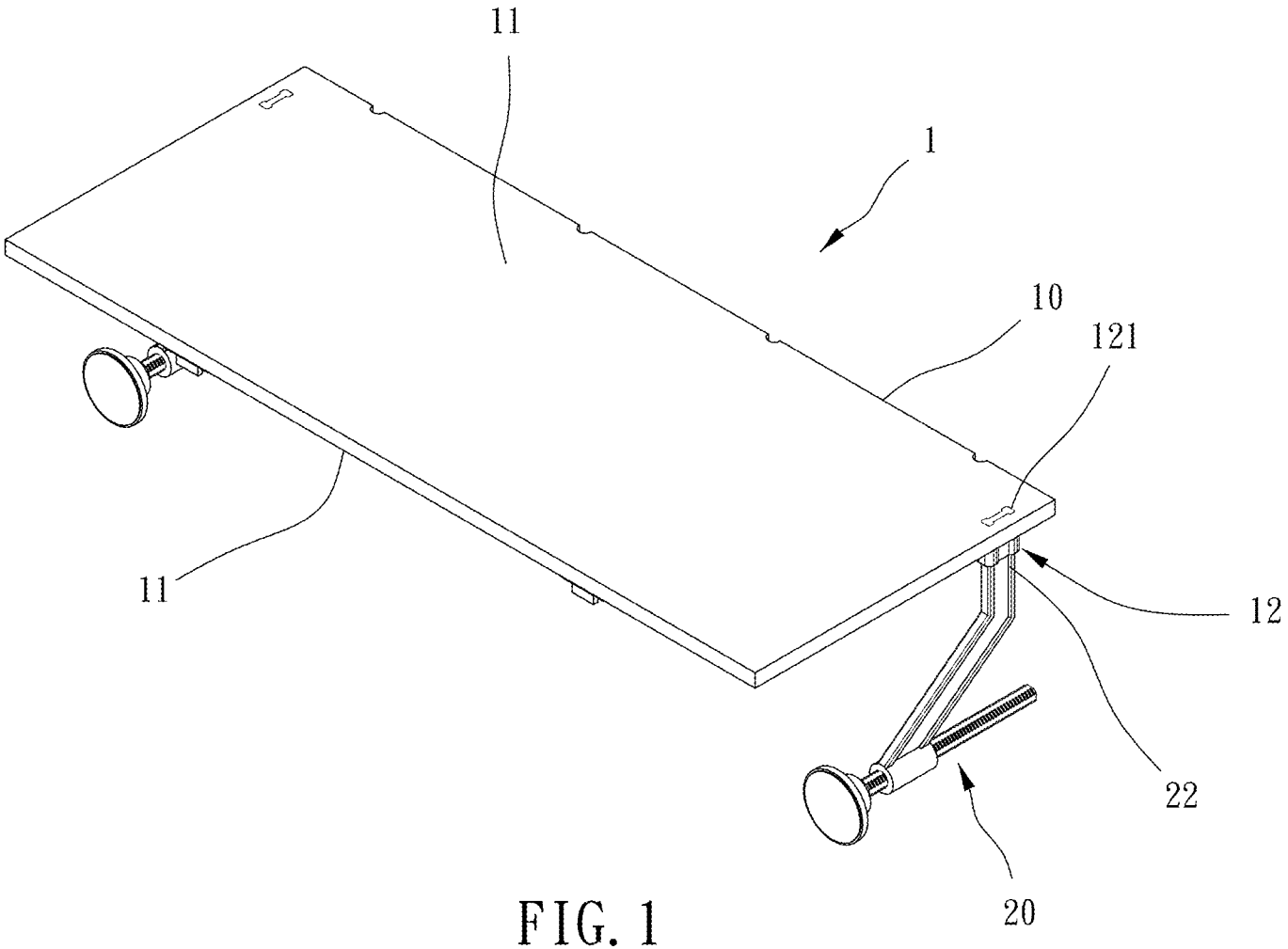
FIG. 1 is a stereogram of a preferable embodiment of the present invention.
Figure 2:
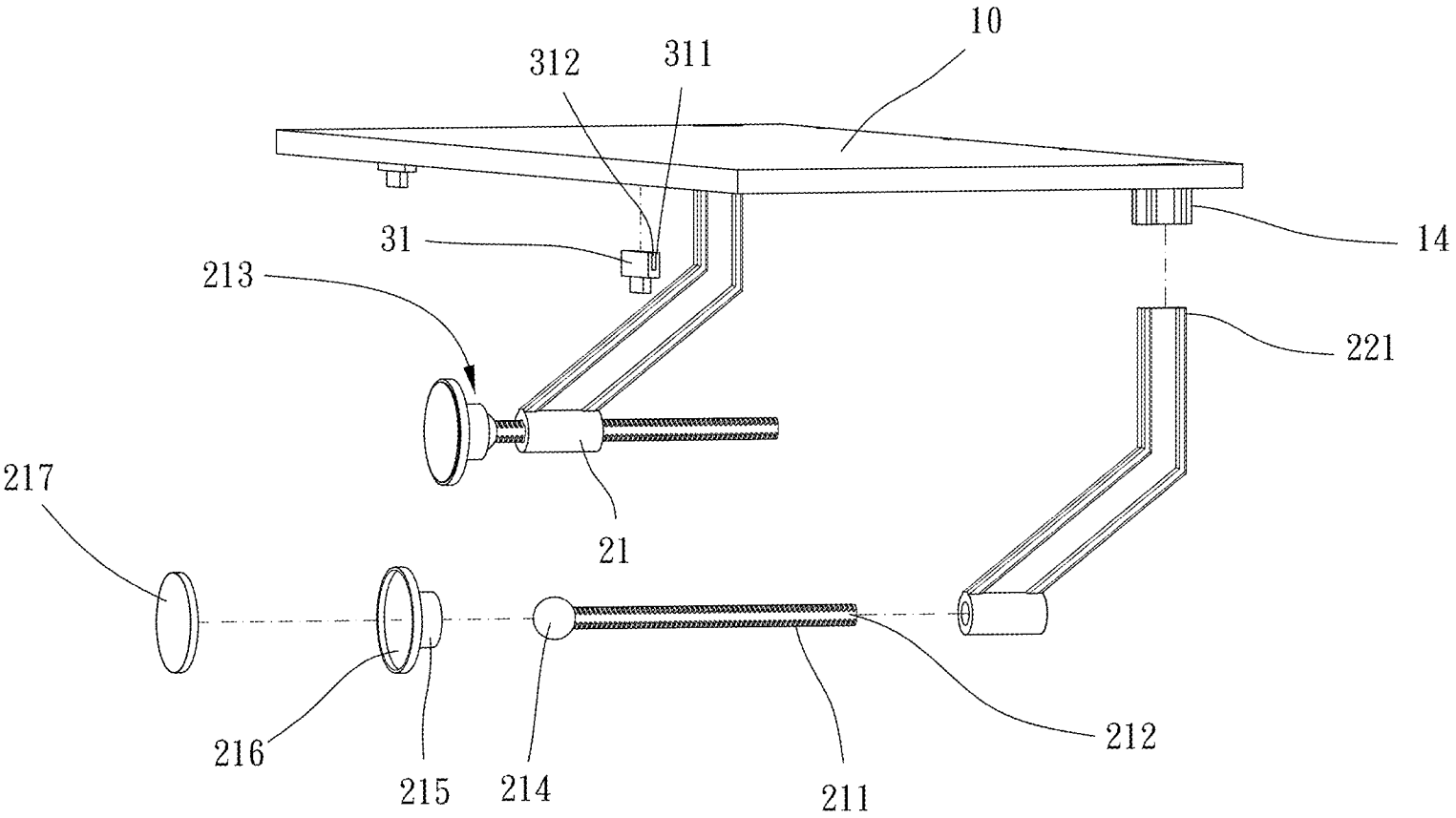
FIG. 2 is a breakdown drawing of a preferable embodiment of the present invention.
Figure 4:
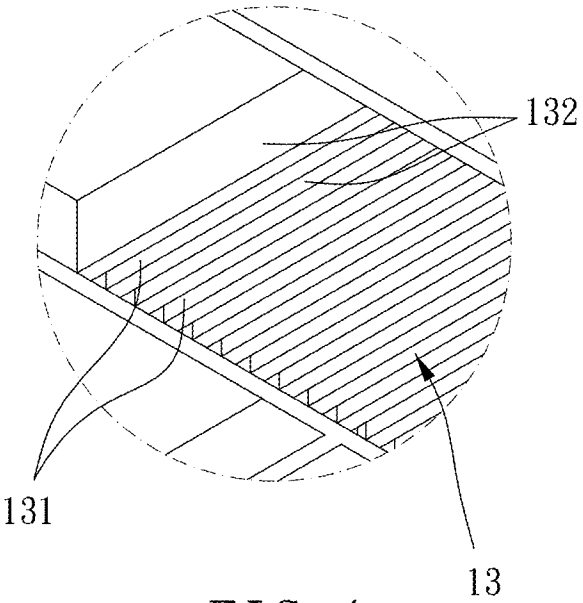
FIG. 4 is a partial enlargement of FIG. 3.
Figure 3:
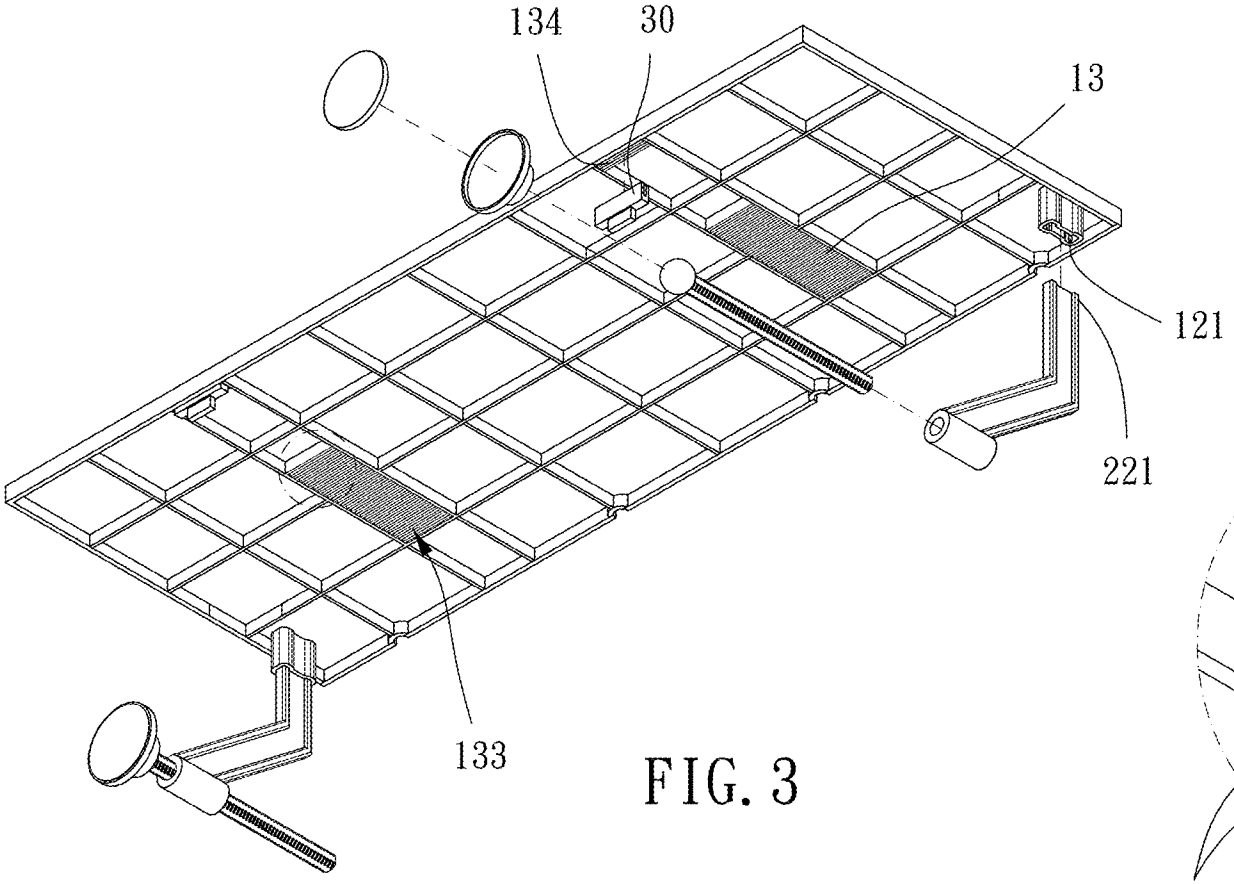
FIG. 3 is a perspective breakdown drawing of a preferable embodiment of the present invention.
Figure 5:
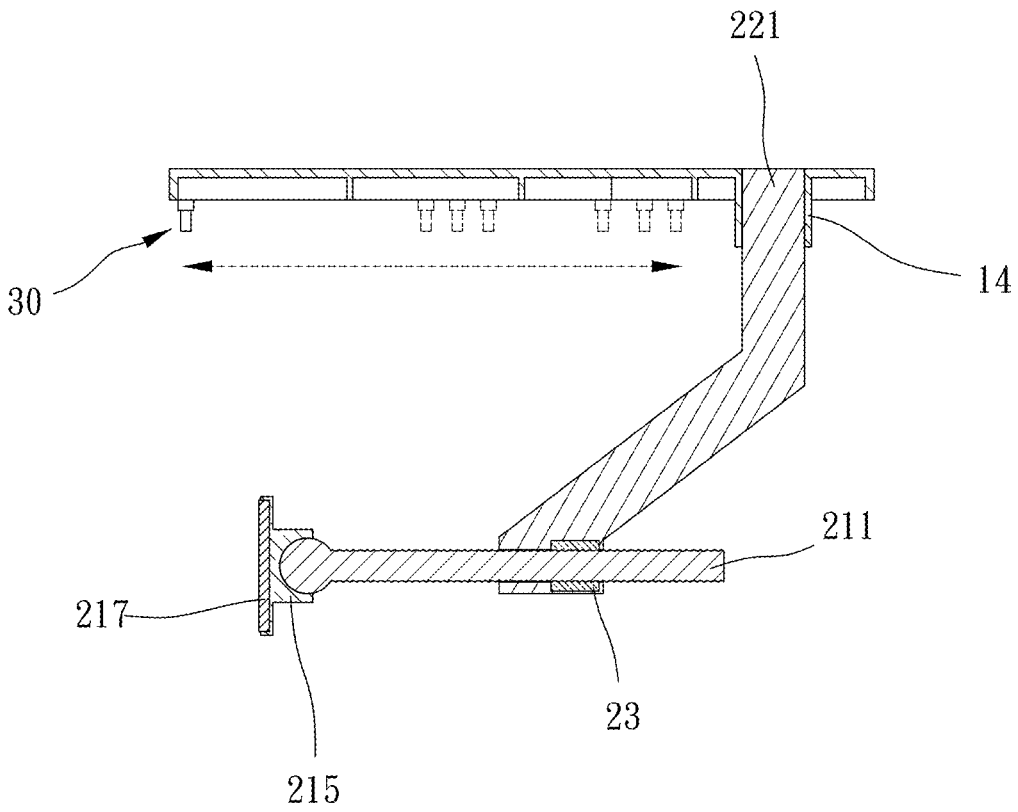
FIG. 5 is a cross-sectional view of a preferable embodiment of the present invention.
Figure 6:
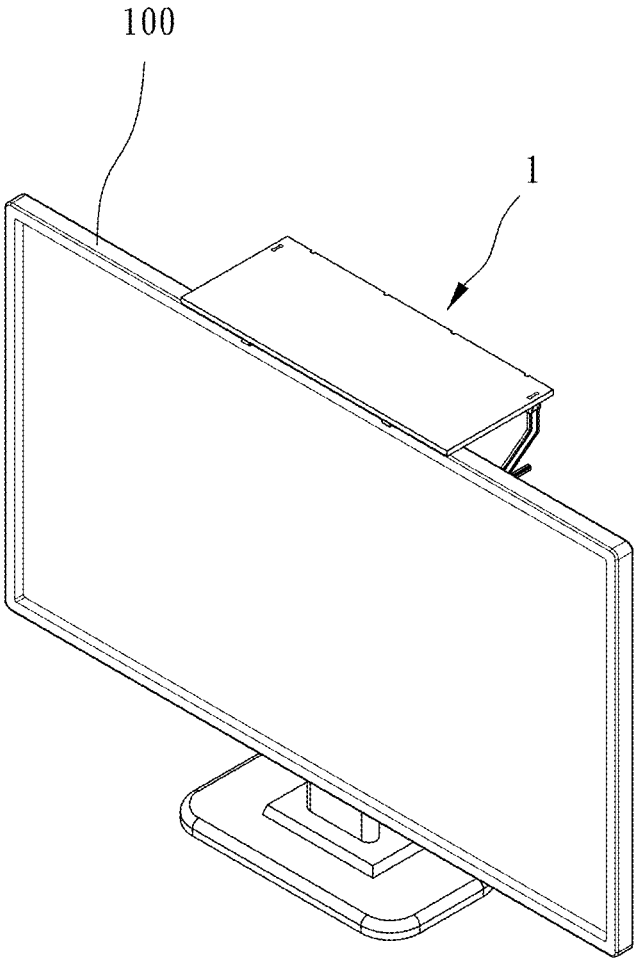
FIG. 6 is a drawing showing a shelving device supported directly on one single article according a preferable embodiment of the present invention.
Figure 7:
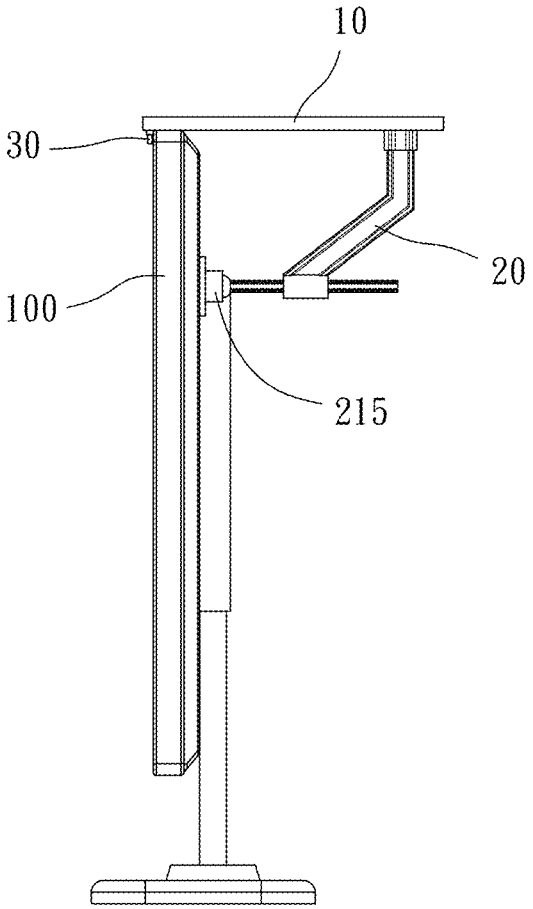
FIG. 7 is a side view of FIG. 6.
Figure 8:
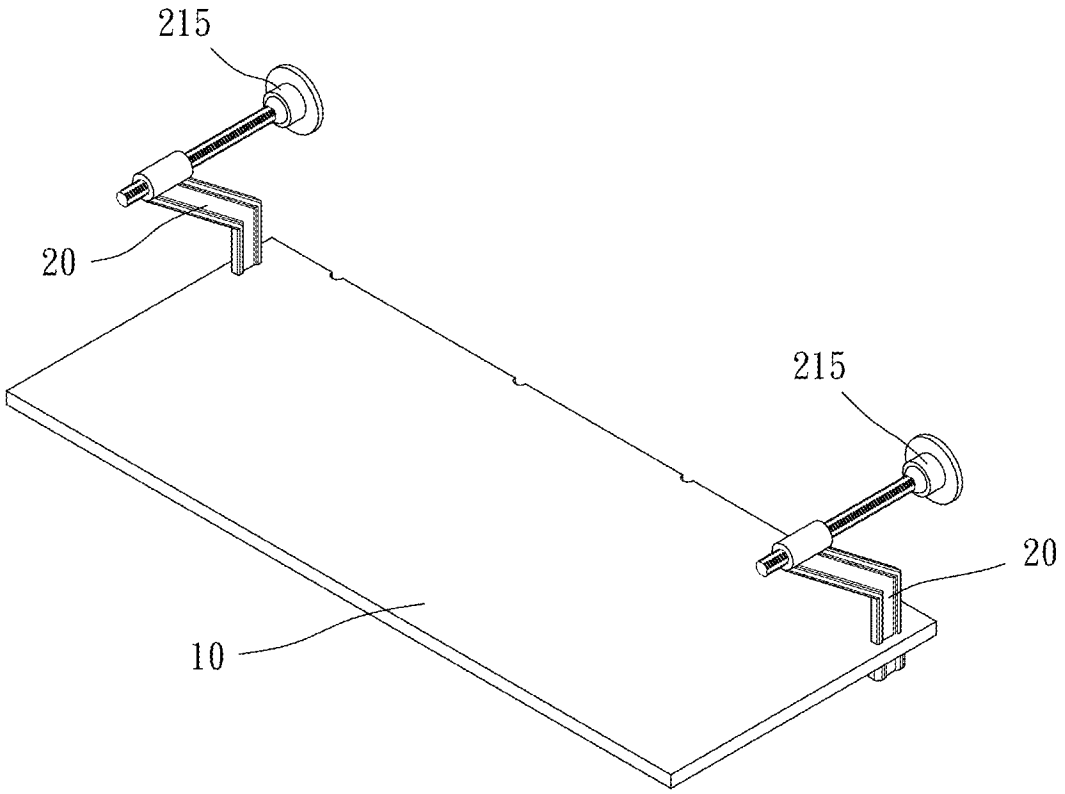
FIG. 8 is another stereogram of a preferable embodiment of the present invention.
Figure 9:
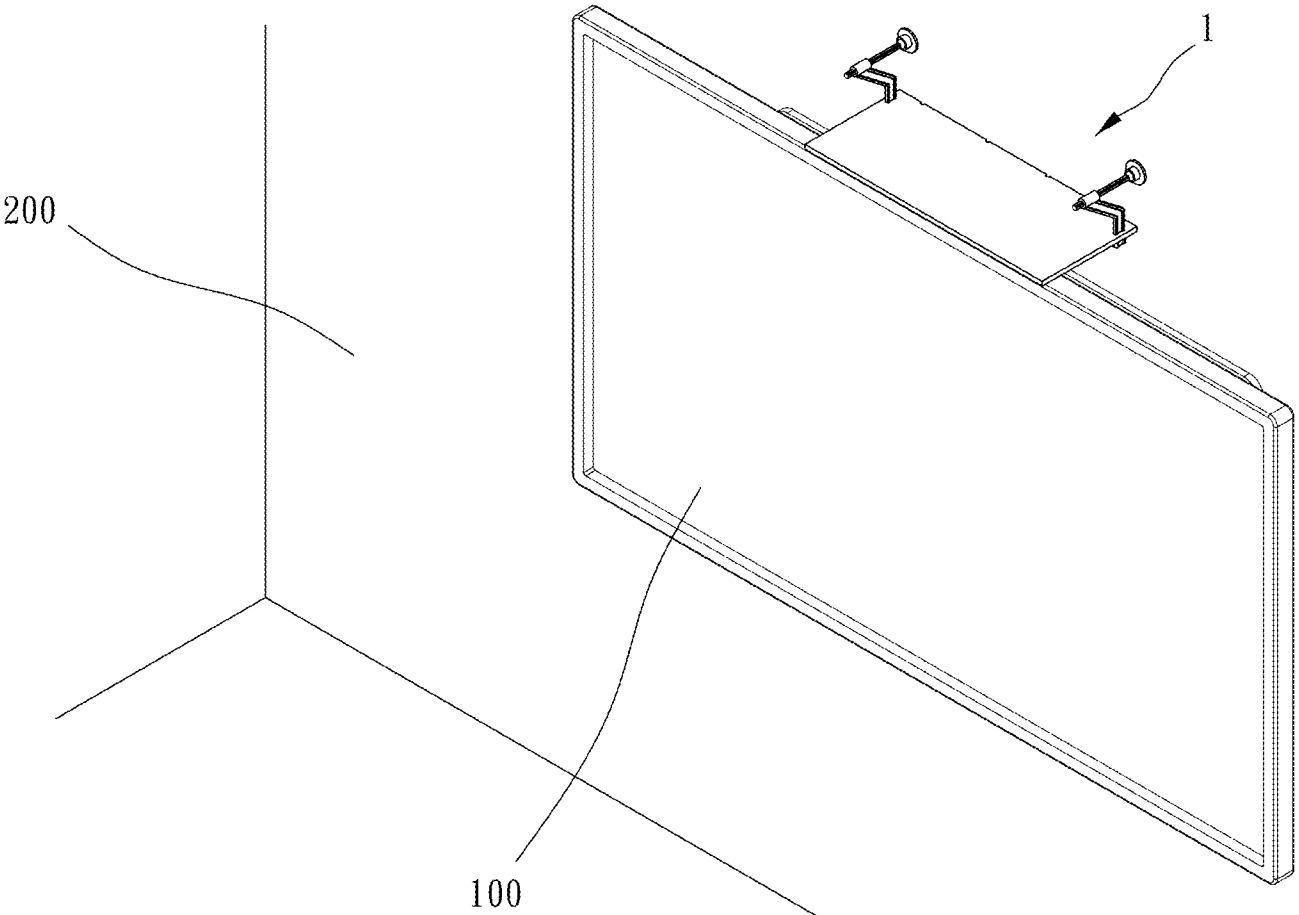
FIGS. 9 and 10 are drawings showing a shelving device supported between two articles according a preferable embodiment of the present invention.
Figure 10:
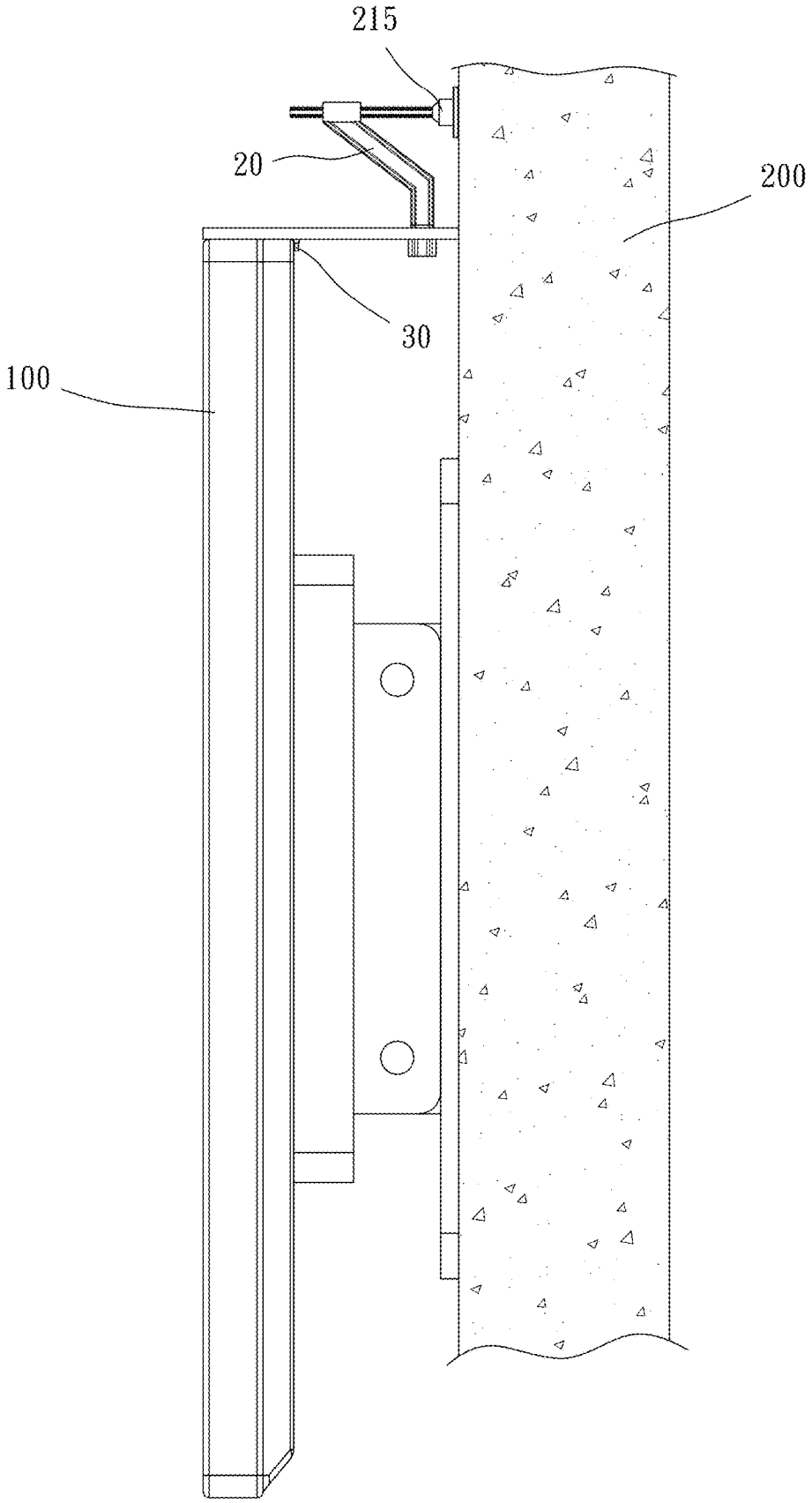

The carrier 10 includes two sides 11 which are opposite to each other and two first assembling mechanisms 12 disposed on the two sides; each of the at least one support mechanism 20 is detachably assembled with one of the two first assembling mechanisms 12, each of the at least one support mechanism 20 includes a support leg 21 extending laterally to a periphery of the carrier 10 and is configured to be abutted on an installation environment, wherein the installation environment may be a monitor 100 (for example, computer or TV monitor), or may include the monitor 100 and a base 200 (for example, building wall or partition) on which the monitor 100 is mounted; the blocking member 30 is adjustably disposed on at least one of the two sides 11 and configured to be positionally abutted on the installation environment. The shelving device 1 may be provided with a plurality of said blocking members. Whereby, the shelving device can be supported directly on one single article (as shown in FIGS. 6 and 7), or supported between two articles (as shown in FIGS. 8 to 10), thus providing multiple applications.

The carrier 10 further includes a plurality of insertion structures 13, and each said blocking member 30 includes an insertion end 31 detachably connected with one said insertion structure 13. Each said insertion structure 13 includes a recess 131 and a key 132 projecting within the recess 131, and the insertion end 31 includes a head portion 311 engaged within one said recess 131 and a slot 312 disposed on the head portion 311 and receiving one said key 132, and thus the blocking member 30 can be stably assembled with the carrier 10. The plurality of insertion structures 13 includes two long arrangement sections 133 and two short arrangement sections 134, the two long arrangement sections 133 are spacingly disposed on a middle part of the carrier 10, and the two short arrangement sections 134 are spacingly disposed near the periphery of the carrier 10, and thus the blocking member 30 can be adjusted to change its position according to various environmental conditions (as depicted by dashed lines in FIG. 5). It is noted that the plurality of insertion structures can be distributed continuously, in more different regions or in any other regions, thus providing very good applicability for various installation environments.

Figure 12:
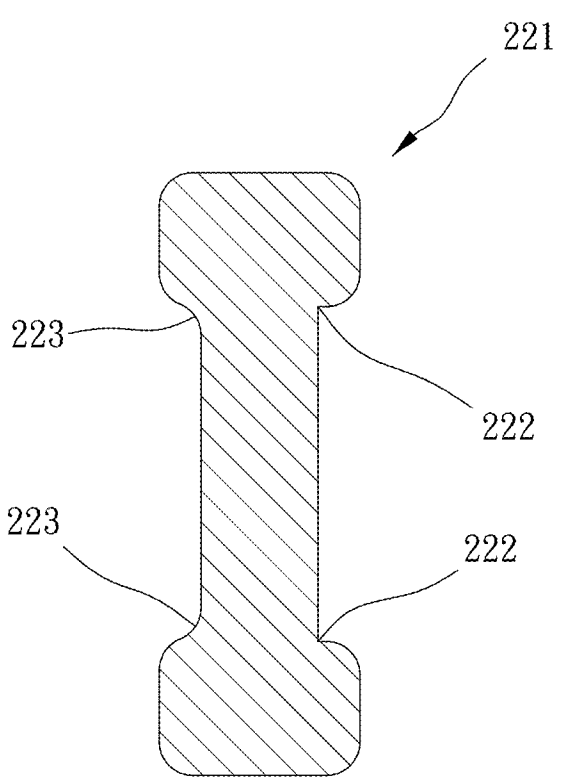
FIGS. 11 and 12 are drawings showing different cross-sections of a support mechanism of the present invention.
Figure 11:
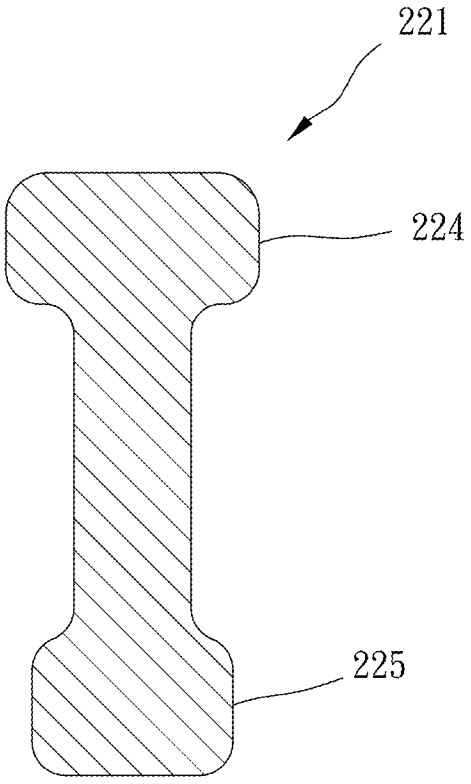

The at least one support mechanism 20 further includes at least one second assembling mechanism 22, each of the at least one second assembling mechanism 22 is detachably connected with one of the two first assembling mechanisms 12, and the first assembling mechanism 12 and the second assembling mechanism 22 include male and female connection structures assemble with each other, respectively. Specifically, each of the two first assembling mechanisms 12 includes two insertion holes 121 disposed respectively on the two sides 11, the shelving device includes a plurality of said support mechanisms 20, each said second assembling mechanism 22 includes a plug 221 detachably inserted in one said insertion hole 121. The carrier 10 further includes at least one tubular projection 14, and each of the at least one tubular projection 14 defines an insertion hole 121, wherein the tubular projection 14 can reinforce the combination of the support mechanism 20 and the carrier 10. Each of the insertion hole 121 and the plug 221 has a cross-section which is I-shaped, thus providing good structural strength. Two end portions of the cross-section of the plug 221 which extend laterally may be different in size or shape, for indication of assembling direction of parts. For example, in an exemplary embodiment shown in FIG. 11, two end portions 224, 225 of the cross-section of the plug 221 have different sizes; in another exemplary embodiment shown in FIG. 12, the cross-section of the plug 221 which is I-shaped has different transitional interconnection sections 222, 223 between respective one of two end portions which extend laterally and a longitudinal portion.

In this embodiment, the carrier 10 includes a plurality of said tubular projections 14, the plurality of said tubular projections 14 are disposed near two corners of the carrier 10 and remote from the two short arrangement sections 134. A distance between neighboring two of the plurality of said tubular projections 14 is larger than a distance between the two long arrangement sections 133, which enhances supporting ability and stability of the plurality of said support mechanism 20. Each of the plurality of said tubular projections 14 defines one said insertion hole 121, one said insertion hole 121 on one of the two sides 11 is communicated with one said insertion hole 121 on the other of the two sides 11, which has a simple structure and is easy to manufactured.

The support leg 21 includes a threaded rod 211 which is adjustable, and the threaded rod 211 is configured to be adjusted to move toward or away from the installation environment. Specifically, the threaded rod 211 includes at least one non-threaded plane 212 extending axially thereon. Preferably, the threaded rod 211 includes a plurality of said non-threaded planes 212 equiangularly arranged thereon, thus allowing turning and adjusting the threaded rod 211 directly; the threaded rod 211 further includes a universal structure 213 at one end, the universal structure 213 includes a ball head 214 connected to the threaded rod 211 and an abutment member 215 to which the ball head 214 is rotatably attached, thus being capable of stable abutment on different configurations of surfaces of various articles; the abutment member 215 includes a groove 216 within which an anti-clip pad 217 is disposed to avoid slippage; each said support mechanism 20 extends transitionally and includes a nut 23 screwed with the threaded rod 211, the nut 23 and the abutment member 215 are located by two opposite sides of the ball head 214, and thus the support mechanism 20 further includes a tubular section configured to improve stabilization and connection of the threaded rod 211. The nut may be configured to be freely rotatable in place for facilitating adjustment of the threaded rod; the support mechanism may be integrally formed to include an internal threaded portion, and none of nut is required.

In operation, when the shelving device 1 is going to be supported directly on one single article such as monitor 100 (as shown in FIGS. 6 and 7), the blocking member 30 is assembled to the short arrangement section 134 and hooked on a front side of a frame of the monitor 100, the threaded rod 211 is rotated to adjust its extension, and the abutment member 215 of each said support mechanism 20 extends inwardly to abut on the back of the monitor 100, so that the shelving device 1 is capable of stable mounting on the monitor 100; when the shelving device 1 is going to be supported between two articles such as the monitor 100 and building wall (as shown in FIGS. 9 and 10), the blocking member 30 is assembled to the long arrangement section 133 (optionally assembled to the short arrangement section 134) abutted against a rear side of a frame of the monitor 100, the threaded rod 211 is rotated to adjust its extension, and the abutment member 215 of each said support mechanism 20 extends outwardly to abut on a base 200 (building wall or partition) configured for the monitor 100 to be mounted thereon, and the rear side of the carrier 10 is preferably abutted against the base 200, so that the shelving device 1 is capable of being stably mounted between two articles.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A shelving device, including:

a carrier, including two sides which are opposite to each other and two first assembling mechanisms disposed on the two sides;

at least one support mechanism, each of the at least one support mechanism being detachably assembled with one of the two first assembling mechanisms, including a support leg extending laterally to a periphery of the carrier and being configured to be abutted on an installation environment; and a blocking member, adjustably disposed on at least one of the two sides, configured to be positionally abutted on the installation environment;

wherein the carrier further includes a plurality of insertion structures, and each said blocking member includes an insertion end detachably connected with one said insertion structure;

wherein the plurality of insertion structures includes two long arrangement sections and two short arrangement sections, the two long arrangement sections are spacingly disposed on a middle part of the carrier, and the two short arrangement sections are spacingly disposed near the periphery of the carrier.

2. The shelving device of claim 1, wherein the support leg includes a threaded rod which is adjustable, and the threaded rod is configured to be adjusted to move toward or away from the installation environment.

3. The shelving device of claim 2, wherein the threaded rod includes at least one non-threaded plane extending axially thereon.

4. A shelving device, including:

a carrier, including two sides which are opposite to each other and two first assembling mechanisms disposed on the two sides;

at least one support mechanism, each of the at least one support mechanism being detachably assembled with one of the two first assembling mechanisms, including a support leg extending laterally to a periphery of the carrier and being configured to be abutted on an installation environment; and a blocking member, adjustably disposed on at least one of the two sides, configured to be positionally abutted on the installation environment;

wherein the at least one support mechanism further includes at least one second assembling mechanism, each of the at least one second assembling mechanism is detachably connected with one of the two first assembling mechanisms, and the first assembling mechanism and the second assembling mechanism include male and female connection structures assemble with each other, respectively;

wherein each of the two first assembling mechanisms includes two insertion holes disposed respectively on the two sides, and each of the at least one second assembling mechanism includes a plug detachably inserted in one said insertion hole;

wherein each of the insertion hole and the plug includes a cross-section which is I-shaped.

5. The shelving device of claim 4, wherein two end portions of the cross-section which extend laterally are different in size or shape.

6. The shelving device of claim 5, wherein the at least one support mechanism is at least two support mechanisms; the support leg includes a threaded rod which is adjustable, and the threaded rod is configured to be adjusted to move toward or away from the installation environment; the threaded rod includes a plurality of non-threaded planes equiangularly arranged thereon; the threaded rod further includes a universal structure at one end, the universal structure includes a ball head connected to the threaded rod and an abutment member to which the ball head is rotatably attached, the abutment member includes a groove within which an anti-clip pad is disposed; the carrier further includes a plurality of insertion structures, and each said blocking member includes an insertion end detachably connected with one said insertion structure; each said insertion structure includes a recess and a key projecting within the recess, the insertion end includes a head portion engaged within one said recess and a slot disposed on the head portion and receiving one said key; the plurality of insertion structures includes two long arrangement sections and two short arrangement sections, the two long arrangement sections are spacingly disposed on a middle part of the carrier, and the two short arrangement sections are spacingly disposed near the periphery of the carrier; the carrier includes a plurality of tubular projections projecting therefrom, the plurality of tubular projections are disposed near two corners of the carrier and remote from the two short arrangement sections, a distance between neighboring two of the plurality of tubular projections is larger than a distance between the two long arrangement sections, each of the plurality of tubular projections defines one said insertion hole, one said insertion hole on one of the two sides is communicated with one said insertion hole on the other of the two sides; each said support mechanism extends transitionally and includes a nut screwed with the threaded rod, and the nut and the abutment member are located by two opposite sides of the ball head.

7. A shelving device, including:

a carrier, including two sides which are opposite to each other and two first assembling mechanisms disposed on the two sides;

at least one support mechanism, each of the at least one support mechanism being detachably assembled with one of the two first assembling mechanisms, including a support leg extending laterally to a periphery of the carrier and being configured to be abutted on an installation environment; and a blocking member, adjustably disposed on at least one of the two sides, configured to be positionally abutted on the installation environment;

wherein the at least one support mechanism further includes at least one second assembling mechanism, each of the at least one second assembling mechanism is detachably connected with one of the two first assembling mechanisms, and the first assembling mechanism and the second assembling mechanism include male and female connection structures assemble with each other, respectively;

wherein each of the two first assembling mechanisms includes two insertion holes disposed respectively on the two sides, and each of the at least one second assembling mechanism includes a plug detachably inserted in one said insertion hole;

wherein the carrier further includes at least one tubular projection projecting therefrom, and each of the at least one tubular projection defines one said insertion hole.

* * * * *